US008493161B2

(12) United States Patent
Bosshard et al.

(10) Patent No.: US 8,493,161 B2
(45) Date of Patent: Jul. 23, 2013

(54) COMPACT EXCITATION ASSEMBLY FOR GENERATING A CIRCULAR POLARIZATION IN AN ANTENNA AND METHOD OF FASHIONING SUCH A COMPACT EXCITATION ASSEMBLY

(75) Inventors: Pierre Bosshard, Tournefeuille (FR); Philippe Lepeltier, Castanet (FR); Alain Lasserre, Tournefeuille (FR); Sophie Verlhac, Le Castera (FR)

(73) Assignee: Thales, Neuilly sur Seine (FR)

( * ) Notice: Subject to any disclaimer, the term of this patent is extended or adjusted under 35 U.S.C. 154(b) by 595 days.

(21) Appl. No.: 12/577,515

(22) Filed: Oct. 12, 2009

(65) Prior Publication Data

US 2010/0149058 A1 Jun. 17, 2010

(30) Foreign Application Priority Data

Dec. 16, 2008 (FR) ..... 08 07063

(51) Int. Cl.
*H01P 1/17* (2006.01)
*H01P 5/12* (2006.01)

(52) U.S. Cl.
USPC ..... 333/21 A; 333/135

(58) Field of Classification Search
USPC ..... 333/125, 126, 135, 137, 21 A
See application file for complete search history.

(56) References Cited

U.S. PATENT DOCUMENTS 4,060,808 A 11/1977 Foldes
7,408,427 B1 * 8/2008 Lee-Yow et al. ..... 333/126

FOREIGN PATENT DOCUMENTS

DE 31 11 106 A1 9/1982
WO WO 00/16431 A1 3/2000
WO WO 2008/012369 A1 1/2008

OTHER PUBLICATIONS

P-N Designs Inc, "Quadrature couplers", Oct. 23, 2010, www.microwaves101.com.*

* cited by examiner

*Primary Examiner* — Benny Lee
*Assistant Examiner* — Gerald Stevens
(74) *Attorney, Agent, or Firm* — Baker Hostetler LLP

(57) ABSTRACT

A compact excitation assembly for generating a circular polarization in an antenna in particular transmit and/or receive antennas such as multibeam antennas comprises a diplexing orthomode transducer and a branched coupler and is characterized in that the orthomode transducer (21), or OMT, is asymmetric and comprises a main waveguide (22) with square or circular cross section and longitudinal axis ZZ' and two branches coupled to the main waveguide (22) by respectively two parallel coupling slots (25, 26), the two coupling slots (25, 26) being made in two orthogonal walls of the waveguide, the two branches of the OMT being respectively linked to two waveguides (35, 36) of an unbalanced branched coupler (40), the branched coupler (40) having two different splitting coefficients ($\alpha$, $\beta$) that are optimized in such a way as to compensate for the electric field orthogonal spurious components ($\delta y$, $\delta x$) produced by the asymmetry of the OMT (21).

8 Claims, 6 Drawing Sheets

COMPACT EXCITATION ASSEMBLY FOR GENERATING A CIRCULAR POLARIZATION IN AN ANTENNA AND METHOD OF FASHIONING SUCH A COMPACT EXCITATION ASSEMBLY

CROSS-REFERENCE TO RELATED APPLICATIONS

This application claims priority of French application no. FR 08/07063, filed Dec. 16, 2008, the disclosure of which is hereby incorporated by reference in its entirety.

FIELD OF THE INVENTION

The present invention relates to a compact excitation assembly for generating a circular polarization in an antenna, to an antenna comprising a compact excitation assembly such as this and to a method of fashioning a compact excitation assembly such as this. It applies notably to the realm of transmit and/or receive antennas and more particularly to antennas comprising an array of elementary radiating elements linked to an orthomode transduction device associated with a coupler, such as for example multibeam antennas.

BACKGROUND OF THE INVENTION

The fashioning of a large number of contiguous beams involves making an antenna comprising a large number of elementary radiating elements, placed in the focal plane of a parabolic reflector, the spacing of which depends directly on the angular gap between the beams. The volume allotted for the installing of a radiofrequency RF chain responsible for ensuring the transmit and receive functions under circular dual-polarization is bounded by the radiative surface of a radiating element, in the case of a multibeam application.

In the commonest configuration where each source, consisting of a radiating element coupled to a radiofrequency chain, fashions a beam, also called a spot, each beam formed is transmitted for example by a dedicated horn constituting the elementary radiating element and the radiofrequency chain carries out, for each beam, the transmit/receive functions in mono-polarization or in dual-polarization in a frequency band chosen as a function of the requirements of the users and/or operators. Generally, a radiofrequency chain comprises chiefly an exciter and waveguide paths, also called recombination circuits, making it possible to link the radiofrequency hardware components. To fashion a circular polarization, it is known to use an exciter comprising an orthomode transducer known by the acronym OMT (standing for Ortho-Mode Transducer) connected to an elementary radiating element for example of horn type. The OMT feeds the horn (in transmission), or is fed by the horn (in reception), selectively either with a first electromagnetic mode exhibiting a first polarization, or with a second electromagnetic mode exhibiting a second polarization orthogonal to the first. The first and second polarizations, with which are associated two electric field components, are linear and called respectively the horizontal polarization H and the vertical polarization V. The circular polarization is produced by associating the OMT with a branched coupler (also known as a branch line coupler) responsible for placing the electric field components H and V in phase quadrature. The search for a compact solution leads to grouping the radiofrequency hardware components and the recombination circuits of the radiofrequency chain on several levels stacked one below another, as represented for example in FIGS. 1*a* and 1*b* described hereinbelow. However, the higher the number of beams, the greater the complexity, mass and cost of the radiofrequency chain. To further decrease the mass and the cost of a radiofrequency chain, it is therefore necessary to modify its electrical architecture.

SUMMARY OF THE INVENTION

The aim of the present invention is to remedy this problem by proposing a novel excitation assembly operating under dual-polarization, not requiring any adjustment and making it possible to simplify the radiofrequency chain and to render it more compact and to thus decrease the mass and the cost thereof.

Accordingly, the invention relates to a compact excitation assembly for generating a circular polarization in an antenna comprising a diplexing orthomode transducer and a branched coupler, characterized in that the orthomode transducer, called an OMT, is asymmetric and comprises a main waveguide with square or circular cross section and longitudinal axis ZZ' and two branches coupled to the main waveguide by respectively two parallel coupling slots, the two coupling slots being made in two orthogonal walls of the waveguide, the two branches of the OMT being respectively linked to two waveguides of an unbalanced branched coupler, the branched coupler having two different splitting coefficients that are optimized in such a way as to compensate for the electric field orthogonal spurious components produced by the asymmetry of the OMT.

Advantageously, the cross section of the main waveguide of the OMT downstream of the coupling slots is less than the cross section of the main waveguide of the OMT upstream of the coupling slots, the break in cross section forming a short-circuit plane.

Advantageously, the coupling slots of the OMT, having a length L1 and a width L2, are linked to the branched coupler by way of two stub filters placed at a distance D1 from the coupling slots and the distance D1, the length L1 and the width L2 are chosen in such a way as to produce an orthogonality between the electric field spurious components produced by the asymmetry of the OMT.

Advantageously, the splitting coefficients of the branched coupler are determined on the basis of the following three relations:

$$\alpha^2+\beta^2=1$$

$$\alpha.Ex-\beta.\delta y=1/\sqrt{2} \text{ volts/meter}$$

$$\beta.Ey+\alpha.\delta x=1/\sqrt{2} \text{ volts/meter}$$

The invention also relates to an antenna characterized in that it comprises at least one such compact excitation assembly.

Finally, the invention also relates to a method of fashioning a compact excitation assembly for generating a circular polarization in an antenna, characterized in that it consists in coupling an asymmetric OMT orthomode transducer with two branches with an unbalanced branched coupler comprising two different splitting coefficients, in dimensioning the OMT in such a way as to establish a phase quadrature between two electric field spurious components produced by the asymmetry of the OMT, and in optimizing the splitting coefficients of the branched coupler so as to compensate for the two electric field spurious components.

Advantageously, the dimensioning of the OMT consists in determining a length L1 of the coupling slots of the OMT, in determining a distance D1 separating the coupling slots from two stub filters placed between the coupling slots and the branched coupler, in placing a short-circuit plane in the main waveguide of the OMT downstream of the coupling slots, the distance D1, the length L1 and the width L2 being chosen in such a way as to produce an orthogonality between the electric field spurious components produced by the asymmetry of the OMT.

Advantageously, the splitting coefficients of the branched coupler are determined on the basis of the following three relations:

$\alpha^2+\beta^2=1$ $\alpha.Ex-\beta.\delta y=1/\sqrt{2}$ volts/meter $\beta.Ey+\alpha.\delta x=1/\sqrt{2}$ volts/meter

BRIEF DESCRIPTION OF THE DRAWINGS

Other features and advantages of the invention will become more clearly apparent in the subsequent description given by way of purely illustrative and nonlimiting example, with reference to the appended schematic drawings which represent.

DETAILED DESCRIPTION

Figure 1A:
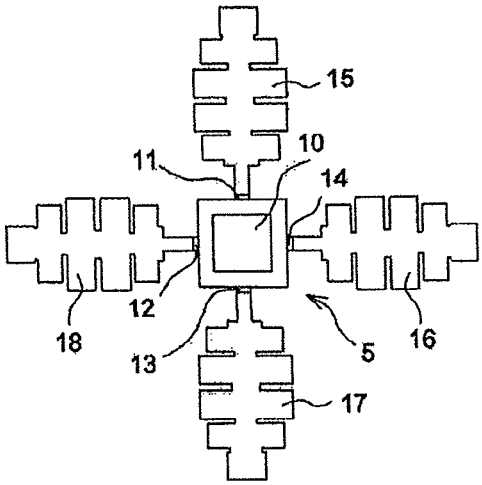
FIG.1a PRIOR ART
FIG. 1*a*: a plan view diagram of an exemplary diplexing OMT, according to the prior art.
Figure 1B:
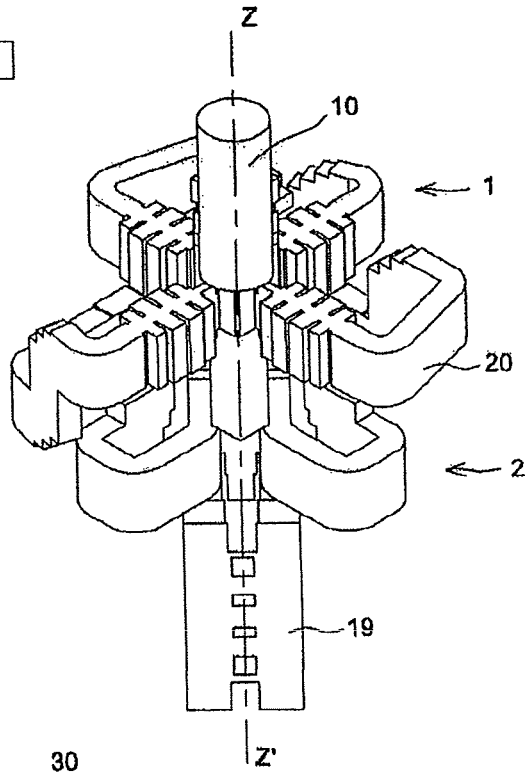
FIG.1b PRIOR ART
FIG. 1*b*: a perspective view of an exemplary RF chain comprising a diplexing OMT of FIG. 1*a;*

The four-branched orthomode transducer 5 represented in FIG. 1*a* comprises a main waveguide 10 with longitudinal axis ZZ', with square or circular cross section for example, having a first end intended to be linked to a horn, not represented, and a second output end, the two ends being situated in the longitudinal axis of the body of the main waveguide. A group of four longitudinal, or transverse, coupling slots 11, 12, 13, 14 in parallel are made in the wall of each of the four lateral faces of the main waveguide and disposed in a pairwise diametrically opposite manner. Between the horn and the coupling slots, the dimensions of the main waveguide 10 are adapted to the propagation of the fundamental electromagnetic modes associated with the H and V field components of the main waveguide in the transmit and receive frequency bands. Beyond the coupling slots, the cross section of the main waveguide decreases, thus producing a short-circuit plane for the low frequency band. At the cutoff frequency, the guide then behaves as a high-pass filter allowing through only the high frequency band. The H and V field components associated with the TE01 and TE10 fundamental electromagnetic modes of the waveguide with square cross section, or with the TE11H and TE11V modes of the waveguide with circular cross section, are coupled in the low frequency band, for example the transmit band, by the four parallel coupling slots 11, 12, 13, 14. The high frequency band, for example the receive band, is rejected by four stub filters 15, 16, 17, 18 linked to the four parallel inlet slots and propagates in the main waveguide up to its output end. The OMT assembly and filters, called a diplexing OMT, thus exhibits six physical ports and its operation is compatible with an application in linear polarization or a circular polarization. The low frequency band may for example be reserved for the transmission of RF radiofrequency signals and the high frequency band may be reserved for the reception of the RF signals. As represented in FIG. 1*b*, on transmission, the fashioning of a circular polarization is ensured by a 3 dB balanced branched coupler 19 which feeds the four coupling slots 11, 12, 13, 14 pairwise in phase quadrature. The opposite slots are fed in phase by way of phase recombination circuits 20. The various hardware components of the excitation assembly consisting of the diplexing OMT and of the branched coupler are optimized separately and the overall transfer function results from the intrinsic performance of each hardware component. The geometry of the OMT 5 with four branches imposes, at the location of the coupling slots, a plane of symmetry on the electric field which propagates in the OMT, thereby minimizing the amplitude of the cross-components of the electric field. Thus the purity of circular polarization does not depend on the OMT 5 but only on the branched coupler 19 and the recombination circuits 20 which produce the power splitting and the phase quadrature between the coupling slots. A septum polarizer, not represented, is connected to the output end of the main waveguide of the OMT, the septum polarizer carrying out the fashioning of the circular polarization on reception.

The radiofrequency hardware components and the recombination circuits of the radiofrequency chain are stacked on several levels, two levels 1, 2 are represented in FIG. 1*b* but there are generally three, disposed one under another. The integration of the hardware components is then maximal and to further decrease the mass, volume and cost of the radiofrequency chain, it is necessary to modify its architecture.

Figure 2:
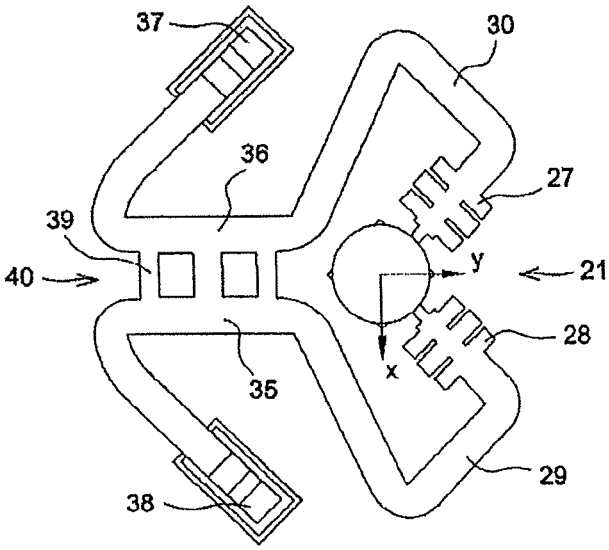
FIG. 2: a sectional view of an exemplary simplified architecture of an RF chain comprising a compact excitation assembly, according to the invention.
Figure 3A:
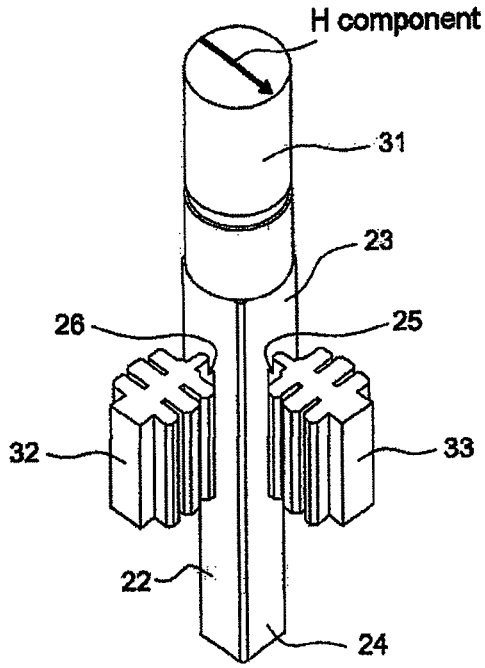
FIGS. 3*a* and 3*b*: two views, respectively in perspective and in plan view, of an exemplary asymmetric diplexing OMT, according to the invention.
Figure 3B:
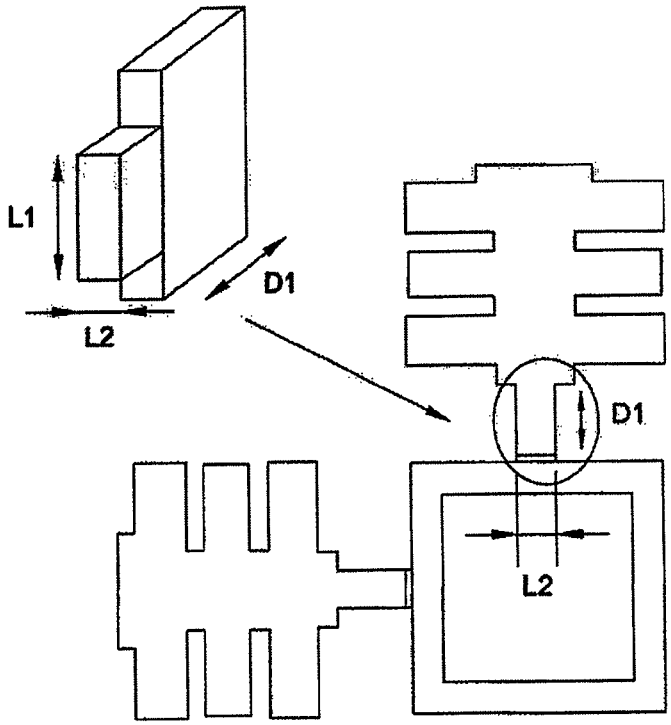

FIG. 2 represents a simplified exemplary architecture of an RF chain comprising a compact excitation assembly, according to the invention. The RF chain essentially comprises a two-branched diplexing orthomode transducer 21 represented in FIGS. 3*a* and 3*b* and an unbalanced branched coupler 40. The OMT 21 comprises a main waveguide 22, for example with square or circular cross section, and of longitudinal axis ZZ', comprising two ends 23, 24, the first end 23 coupled to a circular inlet 31 being intended to be linked to a horn, not represented, and comprising two parallel inlet coupling slots 25, 26 made in the wall of the main waveguide and emerging into the two respective branches of the OMT. The two parallel inlet slots 25, 26 are made in two orthogonal lateral walls of the main waveguide and are disposed, for example and preferably, at one and the same height with respect to the two ends 23, 24 of the main waveguide. The low frequency band may for example be reserved for the transmission of RF signals and the high frequency band may be reserved for the reception of the RF signals. On transmission, each of the two coupling slots 25, 26 is linked to the branched coupler 22 by way of a stub filter 27, 28 and of recombination circuits 29, 30. The circular inlet 31 constitutes the input and output port common to two electric field components, respectively horizontal H and vertical V, corresponding to the two orthogonally polarized electromagnetic modes propagating on transmission and on reception. Each parallel inlet slot associated with a stub filter constitutes an input and output port for one of the electric field components, called the coupled port for this component, the other port being called the isolated port. By way of example, in FIG. 3*a*, the vertical electric field component H passes through the coupled port 32, the port 33 being the isolated port for this component H. For the vertical electric field component V, the coupled port is the port 33 and the isolated port is the port 32. The branched coupler 40 comprises two rectangular waveguides 35, 36 forming two main branches linked respectively, by a first end, to one of the ports 32, 33 of the OMT, and by a second end, to a respective feed inlet 37, 38, the feed inlets 37, 38 having one and the same electric length. Each feed inlet is linked to each of the two main branches 35, 36 of the branched coupler 40 to feed it with an electric field. The two main branches of the branched coupler are coupled together by way of coupling slots, not represented, emerging into at least one transverse waveguide 39 constituting a transverse branch. The length of the transverse guides 39, of predetermined number, for example equal to 3 in FIG. 2, is equal to $\lambda_g/4$ so as to produce, at the output of the branched coupler 40, a 90°phase shift between the two electric field components, $\lambda_g$ being the guided wavelength of the fundamental mode propagating in the main branches 35, 36 of the coupler 40.

On reception, a septum polariser, not represented, may be connected to the second end 24 of the main waveguide of the OMT.

Figure 4:
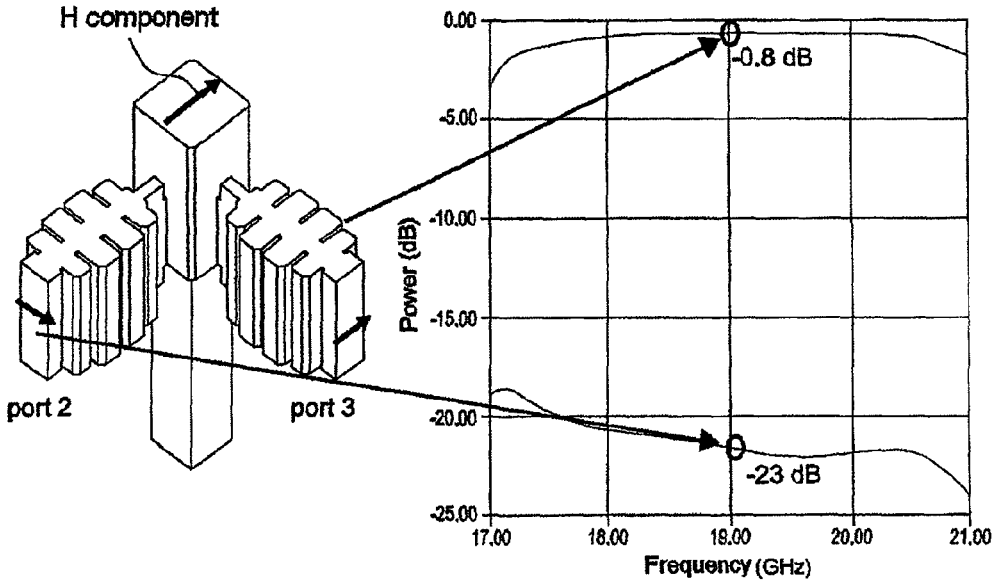
FIG. 4: an exemplary coupling between the two ports, coupled and isolated, obtained with an asymmetric OMT before optimizing the shape of the OMT, according to the invention.
Figure 5:
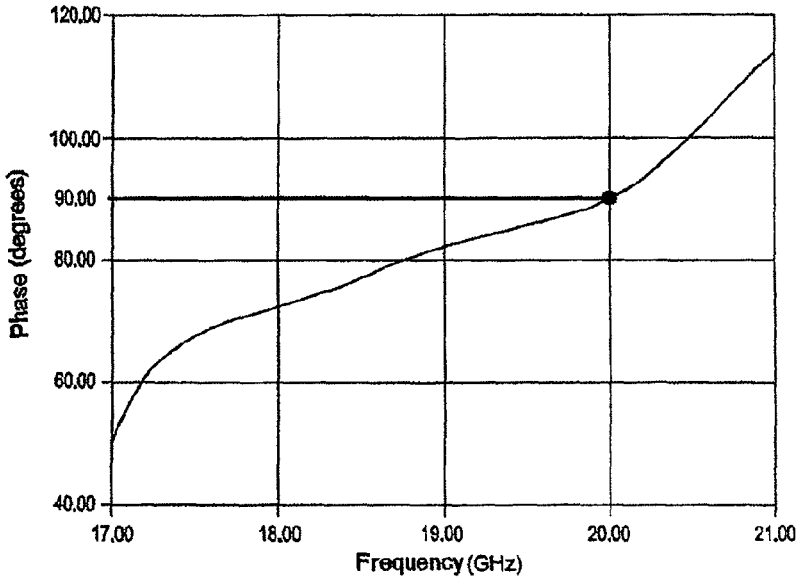
FIG. 5: an exemplary phase dispersion between the ports, coupled and isolated, of an OMT before optimizing the shape of the OMT, according to the invention.

From a geometrical point of view, the two-branched diplexing OMT does not allow the natural decoupling of the horizontal H and vertical V electric field components by virtue of the absence of symmetry at the location of the coupling slots 25, 26. The analysis of the parameters of the dispersion matrix for the energy between the common port 31 and the coupled port 32 corresponding to one of the components of the electric field, then between the common port and the isolated port 33 of the same component of the electric field shows, as represented in FIGS. 4 and 5, that there is a coupling of energy, of the order of −20 dB, between the coupled port and the isolated port and that a frequency-dispersive phase difference exists between the two ports, phase quadrature being obtained only for a particular frequency, although physically the lengths from the common port 31 to the two ports, coupled and isolated 32, 33, are identical. This implies that, on account of the asymmetry of the OMT, the energy of the fundamental mode which propagates in the main waveguide does not pass fully into the coupled port but partly to the isolated port. The distributing of the energy between the two ports is due to the fact that apart from the −20 dB coupling of the TE10 fundamental mode, there is a −20 dB coupling of the TE20 mode (or TE02 mode depending on whether the H or V component of the electric field is considered) between the coupled port and the isolated port. The TE20 (or TE02) mode interferes with the power splitting and induces a different phase insertion of the electric field on the coupled port with respect to the isolated port.

According to the invention, as the two-branched OMT does not allow complete decoupling of the two components of the electric field when it is associated with a 3 dB balanced branched coupler which produces the equal-shares power split and the phase quadrature between the coupling slots, it is not possible to obtain a circular polarization. The polarization obtained is elliptical, with an ellipticity ratio of the radiating field equal to 1.7 dB.

Figure 6:
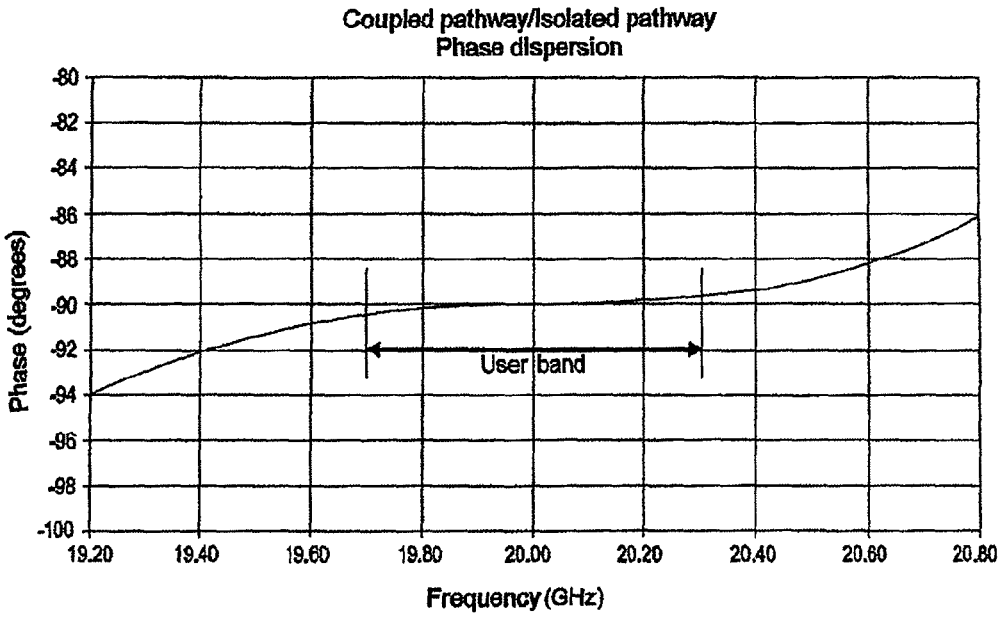
FIG. 6: an exemplary phase dispersion between the ports, coupled and isolated, of an OMT after optimizing the shape parameters of the OMT according to the invention.

However, by acting on the shape parameters of the OMT such as the length L1 and the width L2 of the coupling slots 25, 26, the distance between the slot and the short-circuit plane for the low frequency band corresponding to the changes of cross section of the main guide, the distance D1 between the slots 25, 26 and the start of the stub filters 27, 28, it is possible, as represented in the example of FIG. 6, to place the field component on the isolated port in phase quadrature with the field component on the coupled port and to render the differential behaviour of the phases between these two field components, coupled and isolated, aperiodic on a bandwidth above 7% of the complete low frequency band. The distance D1 acts on the frequency dispersion of phase of the main field component on the coupled port with respect to the spurious field cross-component on the isolated port. The length L1 and the width L2 make it possible to adjust the absolute phase to −90° between the field component on the coupled port and the spurious field component on the isolated port. The distance between the slot and the short-circuit plane may for example be zero. However, the optimization of the shape parameters of the OMT is a multi-variate optimization for which other parameters act to second order, creating for example energy beats between radiofrequency discontinuities, and which it is not possible to optimize other than by successive iterations and by analysing the electromagnetic modes which propagate.

Figure 7:
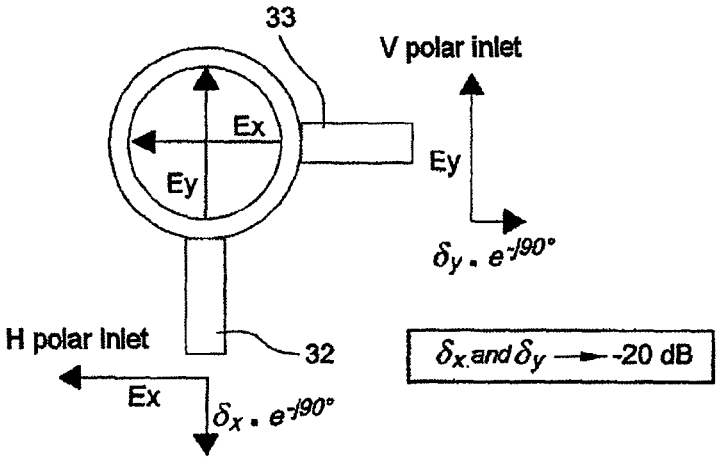
FIG. 7: a schematic plan view of the OMT showing the spurious field components after optimizing the shape parameters of the OMT, according to the invention.

FIG. 7 shows that the electric field resulting from a feed on the inlet port 32, 33 for the horizontal polarization H, respectively vertical polarization V, then decomposes into two components −90° out of phase. Thus, for the inlet port 33 for the vertical component V of the electric field Ey there is added a spurious horizontal component δy −90° out of phase with respect to Ey and for the inlet port 32 for the horizontal component H of the electric field Ex there is added a spurious vertical component δx −90° out of phase with respect to Ex. The spurious components δy and δx are attenuated by 20 dB with respect to the amplitude of Ex and Ey.

The asymmetric OMT, according to the invention, associated with an unbalanced branched coupler, allows compensation for the defect induced by the asymmetry of the OMT and antenna operation under mono-polarization and under dual-polarization with excellent purity of polarization.

Figure 8A:
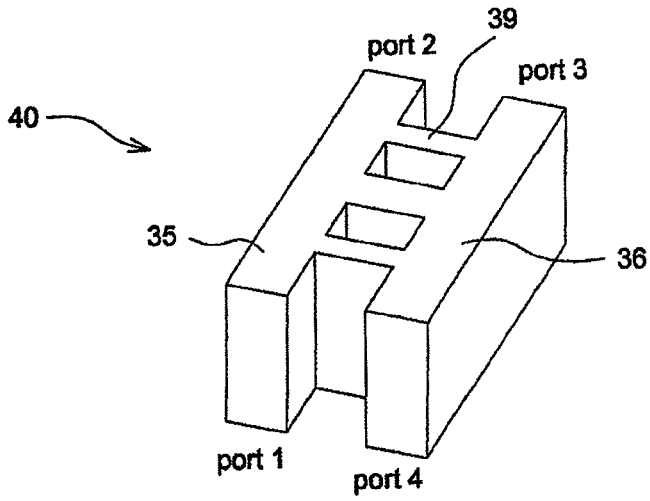
FIGS. 8*a* and 8*b*: a perspective view and a longitudinal sectional view, of an exemplary unbalanced branched coupler, according to the invention.
Figure 8B:
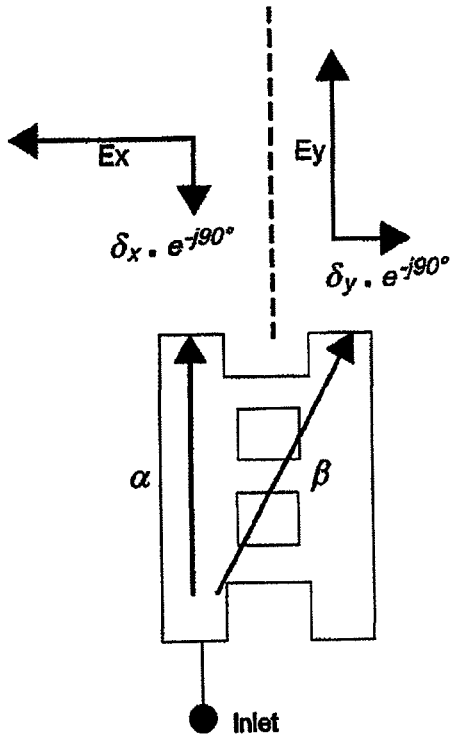

To achieve good purity of circular polarization, the H and V components of the electric field must have the same amplitude and be in phase quadrature. FIGS. 8*a* and 8*b* show a perspective view and a longitudinal sectional view, of an exemplary unbalanced branched coupler 40, according to the invention. The branched coupler 40 comprises four ports 1 to 4 situated at the four ends of the two main branches. The ports 1 and 4 are intended to be linked to the two feed inlets, the two ports 2 and 3 are respectively intended to be linked to the coupled and isolated ports of the OMT. The branched coupler comprises two splitting coefficients α and β, with $\beta=\sqrt{1-\alpha^2}$, responsible for apportioning the energy of the electric field applied to one of its ports 1 or 4 between the ports 2 or 3, with a 90°phase shift in absolute value between ports 2 and 3. Thus when an electric field is applied to port 1, it propagates in the coupler branch linked to port 1 up to port 2 with a coupling coefficient α and propagates diagonally, passing through the coupling slots and the various transverse guides, up to port 3 with the coupling coefficient β. The 90° phase delay between the two electric field components at the output of the branched coupler on ports 2 and 3 corresponds to the lengths of the transverse guides equal to a quarter of the wavelength $\lambda_g/4$. The transverse guides have identical lengths but different widths. The number of transverse branches is chosen as a function of the bandwidth requirement. The widths of the transverse branches are defined as a function of the coupling coefficient values $\alpha$ and $\beta$ to be produced. Conversely, when an electric field is applied to port 4, it propagates in the coupler's main branch linked to port 4 up to port 3 with a coupling coefficient $\alpha$ and propagates diagonally passing through the coupling slots and the various transverse guides, up to port 2 with the coupling coefficient $\beta$ and a phase shift of −90°.

According to the invention, the splitting coefficients $\alpha$ and $\beta$ are chosen in such a way as to compensate for the spurious defect related to the asymmetry of the OMT. Thus the coefficients $\alpha$ and $\beta$ will no longer be equal as is the case in the balanced couplers customarily used with a four-branched OMT, but will be different.

The splitting coefficients are optimized in the presence of the OMT and compensate for the horizontal and vertical spurious components $\delta y$ and $\delta x$ in such a way as to obtain on each output port 2 and 3, half the power received on the input port 1.

The operation of the coupler being symmetric in reception and in transmission, the optimization of the splitting coefficients can be carried out in reception, in such a way as to compensate for the horizontal and vertical spurious components $\delta y$ and $\delta x$ related to the asymmetry of the OMT.

Thus, in reception, on passing through the coupler, the field components entering on port 2, Ex and $\delta y.e^{-j90o}$ become respectively, at output on port 1: $\alpha.Ex$ and $\alpha.\delta x.e^{-j90°}$.

Likewise, the field components entering on port 3, Ey and $\delta y.e^{-j90o}$, become respectively at output on port 1: $\beta.Ey.e^{-90o}$ and $\beta.\delta y.e^{-j180°}$.

The projections of these field components along the orthogonal axes X and Y are then as follows:

Along the X axis: $\alpha.Ex+\beta\delta y.e^{-j180°}$

Along the Y axis: $\beta.Ey.e^{-j90o}+\alpha.\delta x.e^{-j90°}$

Figure 9A:
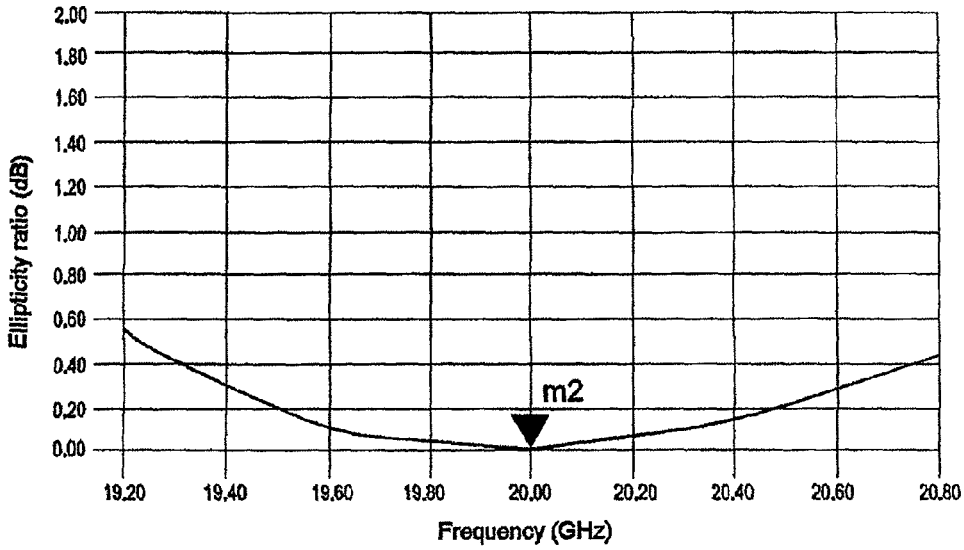
FIGS. 9*a* and 9*b*: an example showing the ellipticity ratio obtained by associating an OMT with two branches and an unbalanced branched coupler to form a compact excitation assembly, according to the invention.
Figure 9B:
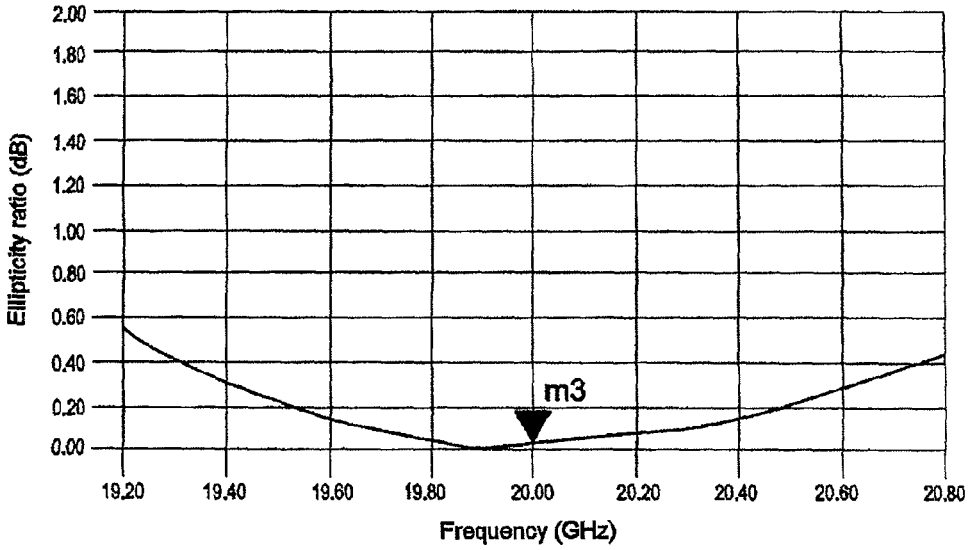

Along the X axis the field components Ex and $\delta y$ sum in phase opposition and the compensation is destructive. Along the Y axis, the field components Ey and $\delta x$ sum in phase and the compensation is constructive. In order for the compensation to make it possible to obtain, on each output port 2 and 3, half the power received on the input port 1, the splitting coefficients $\alpha$ and $\beta$ are such that the following three relations are satisfied:

$\alpha^2+\beta^2=1$ $\alpha.Ex-\beta.\delta y=1/\sqrt{2}$ volts/meter, this corresponding to −3 dB in power $\beta.Ey+\alpha.\delta x=1/\sqrt{2}$ volts/meter, this corresponding to −3 dB in power FIGS. 9*a* and 9*b* show that the ellipticity ratio obtained by associating a two-branched OMT and an unbalanced branched coupler according to the invention, is less than 0.1 dB on the Ka band lying between 19.7 GHz and 20.2 GHz. The ellipticity ratio is less than 0.4 dB over 1.5 GHz of bandwidth, thereby allowing this structure to be used for a user mission but also for other applications whatever the frequency bands.

The novel architecture exhibits the advantages of being very compact, the proportions of the sources thus produced, consisting of the RF chain and of the transmit and receive horn, are 60 mm in diameter and 100 mm in height. By way of comparison, an equivalent-source assemblage according to the prior art exhibits proportions of 150 mm in height and 72 mm in diameter. The production cost is optimal with respect to the number of hardware components. Indeed, the reduction in the number of mechanical parts allows a saving in preparation time. The mass of the RF chain minus the horn is decreased by 60%. The structure is simplified and the number of electric layers is reduced to just one instead of three since the OMT, the branched coupler and the recombination circuits are on one and the same level. The length of the guide paths is decreased by 50%, thus allowing a reduction of 0.1 dB in the ohmic losses relative to the prior art with a four-branched OMT for which the ohmic losses were 0.25 dB.

Although the invention has been described in relation to a particular embodiment, it is obvious that it is in no way limited thereto and that is comprises all the technical equivalents of the means described as well as their combinations if the latter enter into the scope of the invention.

The invention claimed is:

1. A compact excitation assembly for generating a circular polarization in an antenna, the compact excitation assembly comprising:

a diplexing asymmetric orthomode transducer OMT and a branched coupler, wherein:

the OMT is a two-branched OMT and consists of a main waveguide with a square or circular cross section and a longitudinal axis ZZ', and only two branches coupled to the main waveguide by respectively only two parallel coupling slots, the only two parallel coupling slots are spaced apart by 90° and are made in walls of the main waveguide, and the only two branches of the OMT are respectively linked to two waveguides of an unbalanced branched coupler, the unbalanced branched coupler having two different splitting coefficients ($\alpha$, $\beta$) that are optimized to compensate for electric field orthogonal spurious components ($\delta y$, $\delta x$) produced by the asymmetry of the OMT.

2. The compact excitation assembly according to claim 1, wherein the cross section of the main waveguide of the OMT downstream of the two parallel coupling slots is less than the cross section of the main waveguide of the OMT upstream of the two parallel coupling slots, and a break in the cross section of the OMT forms a short-circuit plane.

3. The compact excitation assembly according to claim 1, wherein the two parallel coupling slots of the OMT have a length L1 and a width L2, and are linked to the unbalanced branched coupler by way of two stub filters placed at a distance D1 from the two parallel coupling slots, and the distance D1, the length L1 and the width L2 are chosen to produce orthogonality between the electric field spurious components ($\delta y$, $\delta x$) produced by the asymmetry of the OMT.

4. The compact excitation assembly according to claim 1, wherein the two different splitting coefficients ($\alpha$, $\beta$) of the unbalanced branched coupler are determined based on the following three relations:

$\alpha^2+\beta^2=1$ $\alpha.Ex-\beta.\delta y=1/\sqrt{2}$ volts/meter; and $\beta.Ey-\alpha.\delta x=1/\sqrt{2}$ volts/meter, wherein, wherein Ex represents a vertical component of the electric field and Ey represents a horizontal component of the electric field.

5. The compact excitation assembly according to claim 1, wherein the compact excitation assembly is implemented in the antenna.

6. A method of fashioning a compact excitation assembly for generating a circular polarization in an antenna, the method comprising:

coupling an asymmetric orthomode transducer OMT consisting of only two branches, by respectively only two parallel coupling slots, with an unbalanced branched coupler comprising two different splitting coefficients ($\alpha$, $\beta$);

dimensioning the OMT to establish a phase quadrature between two electric field spurious components ($\delta y$, $\delta x$) produced by the asymmetry of the OMT; and optimizing the two different splitting coefficients ($\alpha$, $\beta$) of the unbalanced branched coupler to compensate for the two electric field spurious components ($\delta y$, $\delta x$).

7. The method according to claim 6, wherein the dimensioning of the OMT comprises:

determining a length L1 and a width L2 of the only two parallel coupling slots of the OMT;

placing a short-circuit plane in a main waveguide of the OMT downstream of the two parallel coupling slots; and determining a distance D1 separating the two parallel coupling slots from two stub filters placed between the two parallel coupling slots and the unbalanced branched coupler, the distance D1, the length L1 and the width L2 being chosen to produce orthogonality between the electric field spurious components ($\delta y$, $\delta x$) produced by the asymmetry of the OMT.

8. The method according to claim 6, wherein the two different splitting coefficients ($\alpha$, $\beta$) of the unbalanced branched coupler are determined based on the following three relations:

$\alpha^2+\beta^2=1$ $\alpha.Ex-\beta.\delta y=1/\sqrt{2}$ volts/meter; and $\beta.Ey-\alpha.\delta x=1/\sqrt{2}$ volts/meter, wherein Ex represents a vertical component of the electric field and Ey represents a horizontal component of the electric field.

* * * * *